US008964349B2

(12) United States Patent
Davis et al.

(10) Patent No.: US 8,964,349 B2
(45) Date of Patent: Feb. 24, 2015

(54) ENERGIZING A COIL OF A SOLENOID OF A DIRECTIONAL CONTROL VALVE

(75) Inventors: Julian R. Davis, North Somerset (GB); Martin Stokes, North Somerset (GB)

(73) Assignee: Vetco Gray Controls Limited, Nailsea (GB)

( * ) Notice: Subject to any disclaimer, the term of this patent is extended or adjusted under 35 U.S.C. 154(b) by 399 days.

(21) Appl. No.: 13/399,329

(22) Filed: Feb. 17, 2012

(65) Prior Publication Data

US 2012/0212873 A1 Aug. 23, 2012

(30) Foreign Application Priority Data

Feb. 22, 2011 (EP) ..... 11155398

(51) Int. Cl.
*H01H 9/00* (2006.01)
*H01F 7/18* (2006.01)

(52) U.S. Cl.
CPC ..... *H01F 7/18* (2013.01); *H01F 2007/1888* (2013.01)
USPC ..... 361/187; 361/194

(58) Field of Classification Search
CPC ..... H01H 47/32; H01H 47/04; H01F 7/1805
USPC ..... 361/187, 194
See application file for complete search history.

(56) References Cited

U.S. PATENT DOCUMENTS 3,865,142 A * 2/1975 Begun et al. ..... 137/635
4,520,420 A 5/1985 Ariyoshi et al.
5,153,522 A 10/1992 Sano
5,241,218 A 8/1993 Page
5,245,501 A 9/1993 Locher et al.
5,796,201 A 8/1998 Kamitani et al.
6,211,665 B1 4/2001 Ahrendt et al.
6,326,898 B1 12/2001 O'Leyar et al.
6,917,203 B1 7/2005 Perotti et al.
7,746,620 B2 * 6/2010 Bedingfield ..... 361/140
2006/0285265 A1 12/2006 Ganev et al.

FOREIGN PATENT DOCUMENTS

DE 3624231 A1 1/1988
EP 2053289 A2 4/2009
GB 2110373 A 6/1983
GB 2205198 A 11/1988
GB 2335797 A 9/1999
WO 9014716 A1 11/1990

OTHER PUBLICATIONS

Search Report and Written Opinion from corresponding EP Application No. 11155398.8, dated Sep. 13, 2011.

* cited by examiner

*Primary Examiner* — Zeev V Kitov
(74) *Attorney, Agent, or Firm* — GE Global Patent Operation

(57) ABSTRACT

A method of energizing a coil of a solenoid of a directional control valve, wherein an armature of the solenoid moves between a first position in which the solenoid is operating and a second position in which the solenoid is not operating, the method comprising energizing the coil with a voltage, controlling the voltage, detecting a current in the coil at which the armature of the solenoid moves between the first position and the second position, and using the current at which the armature of the solenoid moves between the first position and the second position increased by a margin as an operating current for energizing the coil of the solenoid.

20 Claims, 3 Drawing Sheets

ENERGIZING A COIL OF A SOLENOID OF A DIRECTIONAL CONTROL VALVE

BACKGROUND OF THE INVENTION

1. Field of the Invention

Embodiments of the present invention relate to energizing a coil of a solenoid of a directional control valve.

2. Description of the Prior Art

Well production fluid control valves in subsea hydrocarbon production control systems are typically operated by hydraulic actuators. The control of the hydraulic fluid to the valve actuator is typically effected by a directional control valve (DCV), which is a small hydraulic valve, operated by the armature of an electrically operated solenoid. Well complex control systems have a substantial number of DCVs, each requiring electrical power, typically derived from a surface power source via an umbilical. In order to minimize the cost of the umbilical, minimizing the power consumption of the complex is important. The electrical power supplied to DCVs in current systems is intentionally more than enough to operate the DCVs and hold them in their operational positions, mainly as an insurance that the valve will perform reliably. However this results in a considerable waste of power.

BRIEF SUMMARY OF THE INVENTION

According to an embodiment of the present invention, there is provided a method of energizing a coil of a solenoid of a directional control valve, wherein an armature of the solenoid moves between a first position in which the solenoid is operating and a second position in which the solenoid is not operating, the method comprising energizing the coil with a voltage, controlling the voltage, detecting a current in the coil at which the armature of the solenoid moves between the first position and the second position, and using the current at which the armature of the solenoid moves between the first position and the second position increased by a margin as an operating current for energizing the coil of the solenoid.

According to another embodiment of the present invention, there is provided a method of energizing a coil of a solenoid of a directional control valve, wherein an armature of the solenoid moves between a first position in which the solenoid is operating and a second position in which the solenoid is not operating, the method comprising energizing the coil with a voltage, controlling the voltage, detecting the current in the coil at which the armature of the solenoid moves between the first position and the second position, and using the current at which the armature of the solenoid moves between the first position and the second position increased by a margin as an operating current for energizing the coil of the solenoid, wherein controlling the voltage comprises increasing the voltage, detecting the movement of the armature from the second position to the first position, decreasing the voltage when the armature has moved from the second position to the first position, and detecting the movement of the armature from the first position to the second position, increasing the voltage when the armature has moved from the first position to the second position, and detecting the movement of the armature from the second position to the first position, and decreasing the voltage to a level at which the current in the coil is the operating current when the armature has moved from the second position to the first position, wherein detecting the current in the coil at which the armature of the solenoid moves between the first position and the second position comprises detecting a perturbation in the current through the coil due to a change in the inductance of the coil due to the movement of the armature of the solenoid, and wherein controlling the voltage comprises pulse width modulation of voltage applied by drive circuitry for the solenoid.

According to another embodiment of the present invention, there is provided a system for energizing a coil of a solenoid of a directional control valve, the system comprising a DC power supply configured to energize the coil with a voltage, and a processor configured to control the voltage, detect a current in the coil at which an armature of the solenoid moves between a first position in which the solenoid is operating and a second position in which the solenoid is not operating, and use the current at which the armature of the solenoid moves between the first position and the second position increased by a margin as an operating current for energizing the coil of the solenoid.

BRIEF DESCRIPTION OF THE DRAWINGS

The above and other aspects, features, and advantages of the embodiments of the present invention will become more apparent in light of the following detailed description when taken in conjunction with the accompanying drawings in which.

DETAILED DESCRIPTION OF THE INVENTION

Embodiments of the present invention minimize the waste of power and reduce thermal stress in the control system due to the reduced power consumption.

Figure 1A:
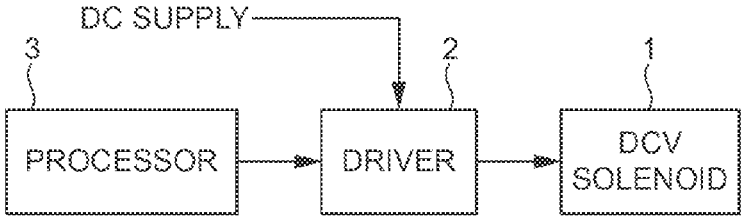
FIG. 1*a* is a block diagram showing items for energizing the coil of a DCV solenoid in accordance with an embodiment of the present invention.

FIG. 1*a* illustrates an arrangement for the operation and control of a DCV in the production control system of a subsea hydrocarbon well. The well control system may include a number of processors, typically housed in a subsea electronics module (SEM), at least one of which will control all of the DCVs on the well, which are housed, along with the SEM, in a subsea control module (SCM) mounted on a well tree. Typically, a DCV is operated by energizing the coil of its solenoid 1 from a DC power supply switched on by a power driver 2 from a control signal (on/off) from a processor 3.

Figure 1B:
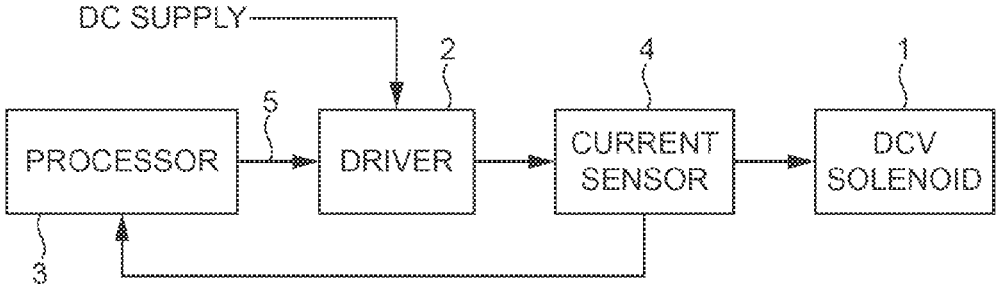
FIG. 1*b* is a block diagram showing items for energizing the coil of a DCV solenoid in accordance with an embodiment of the present invention.

As shown in FIG. 1*b*, in an embodiment of the present invention, the arrangement of FIG. 1*a* is supplemented with current sensing circuitry in the form of a current sensor 4, there being modified software in the processor 3 which controls the power driver 2 by pulse width modulation (PWM) to provide a variable output to the solenoid coil to replace the simple on/off control of power driver 2 of FIG. 1*a*. The power driver 2 is typically a simple transistor, but instead of simply turning the power driver off and on to operate the solenoid, the processor produces a pulse width modulation control on a line 5 to provide the variable voltage required for embodiments of the present invention.

Figure 2:
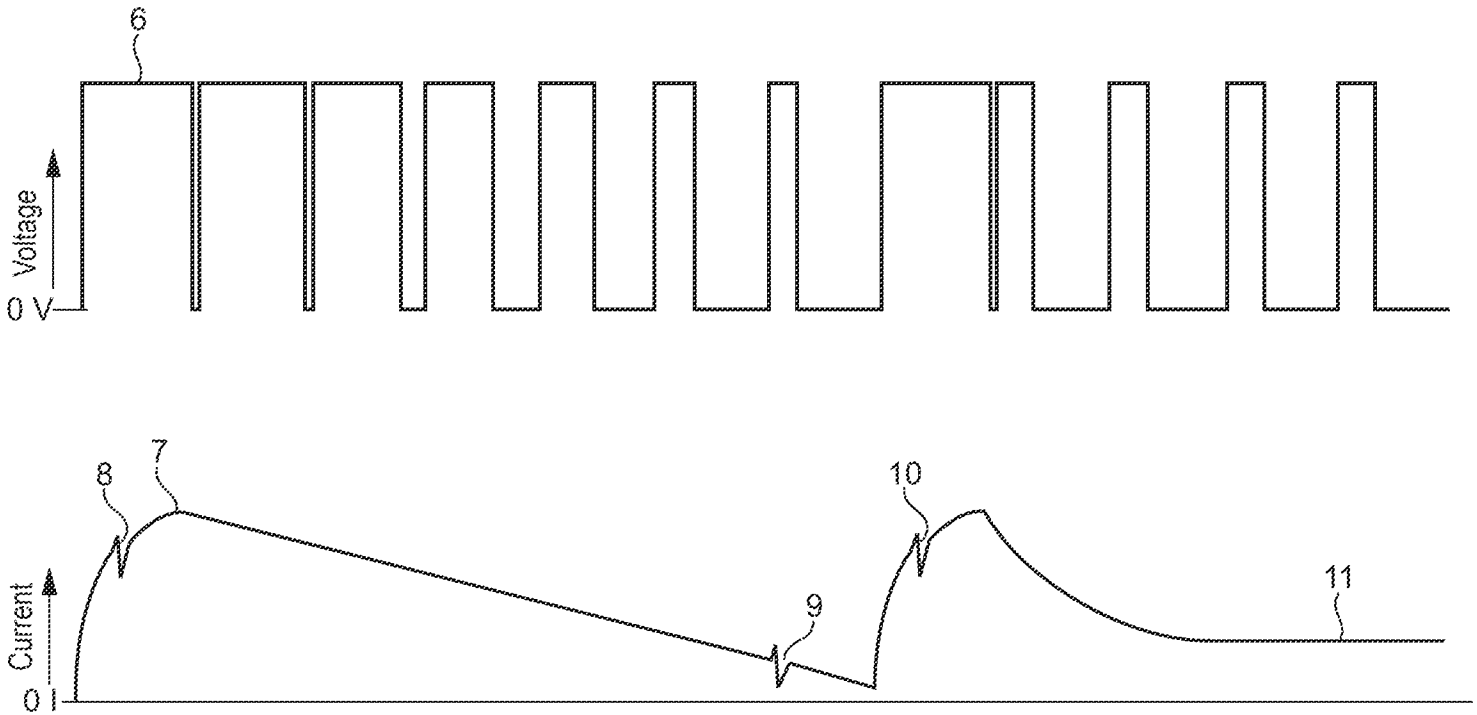
FIG. 2 shows voltage and current waveforms occurring in accordance with an embodiment of the present invention.

FIG. 2 shows how the current in the coil of the DCV solenoid (lower graph) is varied by changing the applied voltage (upper graph) by PWM under the control of the modified software in the processor 3. Optimum power saving can be achieved while maintaining operation of the DCV by determining a minimum "hold-in" current for maintaining operation of the DCV. The mode of operation, controlled by the software in the processor 3, is as follows.

When the DCV is required to operate, the full operating voltage 6 is applied to the solenoid coil, resulting in an exponential rise of current, because of the inductance of the coil up to the maximum 7, as determined by the resistance of the coil. During the rise of current, the solenoid operates the DCV (its solenoid moving from a first position in which the solenoid is not operated to a second position in which the solenoid is operated), resulting in a perturbation 8 in the current, due to the change of inductance of the solenoid coil when the solenoid coil's armature moves. When the maximum current 7 is reached and the processor 3 knows that the solenoid has operated, that is from the current perturbation 8 and the current, both of which were sensed by the current sensor 4 of FIG. 1*b*, the voltage and therefore the current is reduced until the armature moves from the second to the first position and the solenoid 'drops out', resulting in another current perturbation 9, which is sensed and fed to the processor which records the value of the current at that point. By adding a small increase or "margin" to the recorded 'drop out' current, a minimum current required for maintaining operation of the solenoid is established and recorded by the processor 3. This "margin" is established by experimental testing of DCV solenoid characteristics under environmental conditions expected in service and is programmed into the processor 3. When the drop out current has been detected by the processor, full voltage is applied again to the solenoid coil, resulting in a current perturbation 10 when the solenoid operates, which is detected by the processor (which is thus assured that the solenoid has operated again), the processor then reduces the current in the solenoid coil to the value previously established as the minimum "hold-in" current 11.

Thus, substantial power saving is achieved, since the minimum "hold-in" current is typically 70% less than the normal current at full voltage. The use of PWM of voltage as a method of current control is not essential, but generally more power efficient than analogue power control such as simple series transistor circuits with an analogue output from the processor, and is also easier to generate from a processor, since it is inherently digital.

Figure 3:
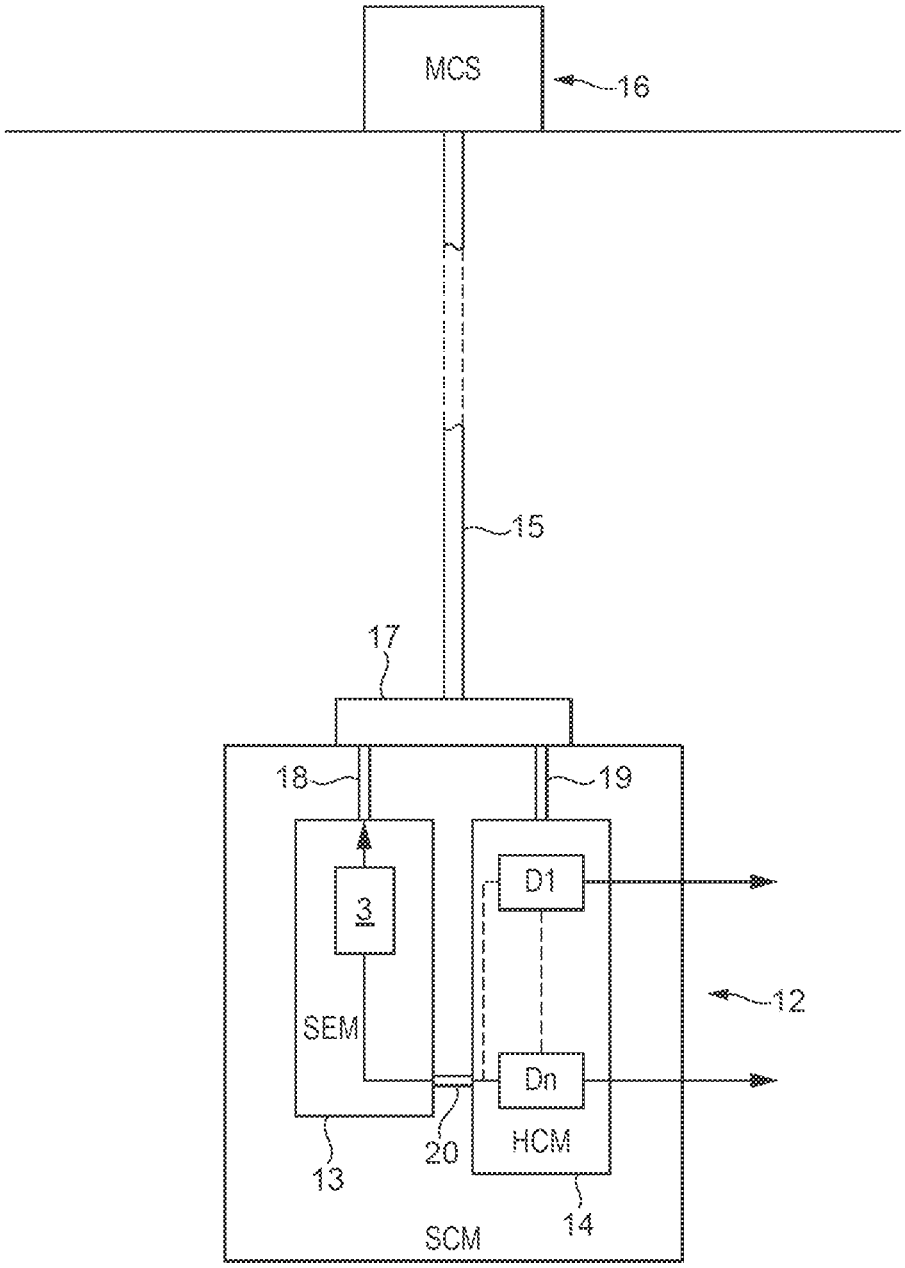
FIG. 3 is a schematic view of a subsea hydrocarbon production control system in accordance with an embodiment of the present invention.

Referring to FIG. 3, this shows schematically a subsea hydrocarbon production control system incorporating embodiments of the present invention. In a subsea control module (SCM) 12 there is a subsea electronics module (SEM) 13 and a hydraulic control module (HCM) 14. The SCM 12 is fed by an umbilical 15 from a topside master control station (MCS) 16, e.g. at a surface platform, with electric power, control signals and hydraulic power. The control signals are processed by the SEM 13 which then controls solenoid operated, hydraulic directional control valves (DCVs) D1-Dn in the HCM 14 which in turn operate a multiplicity of hydraulic devices such as actuators for controlling a subsea hydrocarbon production well. The subsea control system is located at a well tree, the SCM 12 being connected to the umbilical 15 via a distribution unit 17 which provides the electric power and control signals to the SEM 13 via a cable 18 and hydraulic power to the HCM 14 via a feed 19. The SEM 13 controls the DCVs D1-Dn in the HCM 14 via a cable 20.

In accordance with an embodiment of the present invention, the SEM 13 includes a processor 3 for determining minimum "hold-in" currents for the DCVs D1-Dn, current sensors 4 and drivers 2 having been omitted for clarity.

Power saving with operated solenoids is normally achieved by inserting a resistor in series with the solenoid coil with a pair of contacts shorting the resistor, wherein the contacts are opened by the solenoid when it is energized. Thus the solenoid is energized with full voltage and current and then the current is reduced to a level greater than the "drop out" current, thus saving power. However, solenoid operated DCVs on subsea wells have to be highly reliable, and there is an inherent problem with using a shorted resistor method of power saving, wherein a failure of the one of the contacts would leave the resistor in the solenoid circuit and there would then be insufficient voltage and current to operate the solenoid initially. Thus, this simple technique is not reliable enough to be employed on subsea well DCVs. According to an embodiment of the present invention, a method of energizing a coil of a solenoid of a directional control valve uses existing hardware with software to affect the function with only an additional small highly reliable solid state current sensing device, and saves typically 70% of the power requirements of the multiplicity of DCVs on a typical well.

What is claimed is:

1. A method of energizing a coil of a solenoid of a directional control valve, wherein an armature of the solenoid moves between a first position in which the solenoid is operating and a second position in which the solenoid is not operating, the method comprising:

energizing the coil with a voltage;

controlling the voltage to operate the solenoid with a first current;

detecting a second current in the coil, at which the armature of the solenoid moves between the first position in which the solenoid is operated, and the second position in which the solenoid is not operated; and using, as an operating current for energizing the coil of the solenoid, an operating current that is less than the first current but greater by a margin than the second current.

2. The method according to claim 1, wherein controlling the voltage comprises:

increasing the voltage;

detecting the movement of the armature from the second position to the first position;

decreasing the voltage when the armature has moved from the second position to the first position, and detecting the movement of the armature from the first position to the second position;

increasing the voltage when the armature has moved from the first position to the second position, and detecting the movement of the armature from the second position to the first position; and decreasing the voltage to a level at which the current in the coil is the operating current when the armature has moved from the second position to the first position.

3. The method according to claim 2, wherein the voltage is increased to a maximum voltage after detecting the armature has moved from the second position to the first position and before decreasing the voltage.

4. The method according to claim 1, wherein detecting the current in the coil at which the armature of the solenoid moves between the first position and the second position comprises detecting a perturbation in the current through the coil due to a change in the inductance of the coil due to the movement of the armature of the solenoid.

5. The method according to claim 1, wherein controlling the voltage comprises pulse width modulation of voltage applied by drive circuitry for the solenoid.

6. The method according to claim 1, wherein the directional control valve is a directional control valve of a subsea hydrocarbon production control system.

7. The method according to claim 6, wherein the voltage is controlled by a processor in a subsea electronics module of a subsea control module.

8. The method according to claim 2, wherein detecting the current in the coil at which the armature of the solenoid moves between the first position and the second position comprises detecting a perturbation in the current through the coil due to a change in the inductance of the coil due to the movement of the armature of the solenoid.

9. The method according to claim 2, wherein controlling the voltage comprises pulse width modulation of voltage applied by drive circuitry for the solenoid.

10. A method of energizing a coil of a solenoid of a directional control valve, wherein an armature of the solenoid moves between a first position in which the solenoid is operating and a second position in which the solenoid is not operating, the method comprising:

energizing the coil with a voltage;

controlling the voltage to operate the solenoid with a first current;

detecting a second current in the coil at which the armature of the solenoid moves between the first position in which the solenoid is operated, and the second position; and using as an operating current for energizing the coil of the solenoid, an operating current that is less than the first current but greater by a margin than the second current;

wherein controlling the voltage comprises:

increasing the voltage;

detecting the movement of the armature from the second position to the first position;

decreasing the voltage when the armature has moved from the second position to the first position, and detecting the movement of the armature from the first position to the second position;

increasing the voltage when the armature has moved from the first position to the second position, and detecting the movement of the armature from the second position to the first position; and decreasing the voltage to a level at which the current in the coil is the operating current when the armature has moved from the second position to the first position, wherein detecting the current in the coil at which the armature of the solenoid moves between the first position and the second position comprises detecting a perturbation in the current through the coil due to a change in the inductance of the coil due to the movement of the armature of the solenoid, and wherein controlling the voltage comprises pulse width modulation of voltage applied by drive circuitry for the solenoid.

11. A system for energizing a coil of a solenoid of a directional control valve, the system comprising:

a DC power supply configured to energize the coil with a voltage; and a processor configured to: control the voltage to operate the solenoid with a first current; detect a second current in the coil, at which an armature of the solenoid moves between a first position in which the solenoid is operating and a second position in which the solenoid is not operating; and use, as an operating current for energizing the coil of the solenoid, an operating current that is less than the first current but greater by a margin than the second current.

12. The system according to claim 11, wherein the processor is further configured to:

increase the voltage;

detect the movement of the armature from the second position to the first position;

decrease the voltage when the armature has moved from the second position to the first position, and detect the movement of the armature from the first position to the second position;

increase the voltage when the armature has moved from the first position to the second position, and detect the movement of the armature from the second position to the first position; and decrease the voltage to a level at which the current in the coil is the operating current when the armature has moved from the second position to the first position.

13. The system according to claim 12, wherein the processor is configured to increase the voltage to a maximum voltage after detecting the armature has moved from the second position to the first position before the voltage is decreased.

14. The system according to claim 11, wherein the processor is configured to detect the current in the coil at which the armature of the solenoid moves between the first position and the second position by detecting a perturbation in the current through the coil due to a change in the inductance of the coil due to the movement of the armature of the solenoid.

15. The system according to claim 11, wherein the processor is configured to control the voltage by pulse width modulation of voltage applied by drive circuitry for the solenoid.

16. The system according to claim 11, wherein the directional control valve is a directional control valve of a subsea hydrocarbon production control system.

17. The system according to claim 16, wherein the processor is a processor in a subsea electronics module of a subsea control.

18. The system according to claim 12, wherein the processor is configured to detect the current in the coil at which the armature of the solenoid moves between the first position and the second position by detecting a perturbation in the current through the coil due to a change in the inductance of the coil due to the movement of the armature of the solenoid.

19. The arrangement according to claim 14, wherein the processor is configured to control the voltage by pulse width modulation of voltage applied by drive circuitry for the solenoid.

20. The system according to claim 18, wherein the processor is configured to control the voltage by pulse width modulation of voltage applied by drive circuitry for the solenoid.

* * * * *